US005096205A

United States Patent [19]

Dudley

[11] Patent Number: 5,096,205

[45] Date of Patent: Mar. 17, 1992

[54] MULTI SHOT ARROW

[76] Inventor: Jerome M. Dudley, 210 N. Pleasant Ave., Galesburg, Ill. 61401

[21] Appl. No.: 602,649

[22] Filed: Oct. 24, 1990

[51] Int. Cl.[5] ..... F42B 6/04; F42B 6/08

[52] U.S. Cl. ..... 273/415

[58] Field of Search ..... 273/415

[56] References Cited

U.S. PATENT DOCUMENTS

| | | | |
|---|---|---|---|
| 2,873,974 | 2/1959 | Ramsey | 273/415 |
| 2,926,017 | 2/1960 | Ramsey | 273/415 |
| 2,970,838 | 2/1961 | Taggert | 273/415 |
| 3,021,139 | 2/1962 | Buerosse | 273/415 |
| 3,096,091 | 7/1963 | Dudley | 273/415 |
| 3,822,884 | 7/1974 | Curran et al. | 273/415 |

*Primary Examiner*—Paul E. Shapiro

[57] ABSTRACT

A archery device comprising a tubular shaft having a slidable inertial member trapped within the bore extending between the injection molded resilient notch plug conforming with the perimeters of the bore and the notch in the string receiving end and the transversaly positioned back wall of the vented projectile chamber secured within the bore at the forward end of the shaft. Slidable inertial member comprises an elongated metallic weight having at each end an annular goove fitted with a soft flexible foam pad therein and frictionally engaging the interior wall of the tubular shaft. Projectile chamber in the forward end of the shaft is provided with a detachable containment cover having a three sided configuration that fits on the forward end of the shaft with the shaft in longitudinal alignment between the opposing sides of the cover while the closed end of the cover caps the exit end of the projectile chamber in the forward end of the shaft. The longer of the two opposing sides of the cover has at its end a flange bent at a ninety degree angle to facilitate the detachment of the cover by making contact with the bow as the arrow is drawn to near its full length prior to its release thus forcing the cover to leave the shaft. Cover is secured to the shaft by an elastic band transversaly encompassing the cover and shaft while seated in corresponding slots formed in the edges of the opposing sides of the cover.

4 Claims, 1 Drawing Sheet

MULTI SHOT ARROW

DESCRIPTION

1. Technical Field

The invention relates to archery equipment and more particularly to a special purpose arrow therefor.

2. Background Art

The prior art pertaining to this particular type of archery device showed a lack of means to retain possession of projectiles while the device was held in any position other than the projectile chamber pointing in an upward direction.

The present art shows that a modified projectile chamber makes it possible to use a unique detachable containment cover on the projectile chamber that permits carrying the arrow in any position without loss of projectiles before the arrow is shot from the bow.

It is an object of the present invention to provide an arrow having a vented projectile chamber at one forward end releasably supporting a plurality of projectiles for movement toward a target following the release of the arrow, thus increasing the possibility of striking the target.

A further object of the present invention is to provide a multi shot arrow of the above type having self contained inertia means for automatically braking the flight of the arrow following the release there of from the bow.

Still a further object of the present invention is to provide a detachable containment cover for the vented projectile chamber thus allowing the arrow to be transported in any position without loss of projectiles and means to effect the detachment of the cover from the projectile chamber just prior to the release of the arrow from the bow.

DISCLOSURE OF THE INVENTION

The objects have been met by an arrow comprising in combination an elongated tubular shaft having a longitudinal bow extending through the interior thereof. The forward end of the shaft has a vented projectile chamber holding a plurality of projectiles for movement toward a target. The back wall of the projectile chamber is a flat disc positioned transversely in the bore and secured therein. In the aft end of the tubular shaft is positioned an injection molded resilient plug said plug's contours matching the perimeters of the bore and the longitudinal opposing slots that form the string receiving notch at the aft end of the tubular shaft. Holes predrilled through the wall of the shaft in the resilient plug area allow injected material to exude through the holes thus anchoring said resilient plug in place. Trapped in the bore of the tubular shaft between the back wall of the projectile chamber in the forward end of the shaft and the resilient plug in the aft end of said shaft is a weighted object having an annular groove at each end thereof said grooves being fitted with a pair of sponge-type pads within the grooves such pads slidably and frictionally engaging the interior of the longitudinal bore of the shaft so as to facilitate the adjustment of the position of such weight between the opposite ends of the shaft.

Projectile chamber in the fore end of the tubular shaft is fitted with a detachable S shaped cover having opposing sides of varying length, the longer side having at its end a flange which is used in the detachment of the cover from the projectile chamber by said flange making contact with the front of the bow as the arrow is drawn to near its full length and forcing the cover off of the projectile chamber just prior to release of the arrow from the pulled bowstring. The closed end of the S shaped detachable cover fits over the exit end of the projectile chamber while the opposing sides of said cover having the projectile chamber longitudinally aligned between them, grip the exterior wall of said chamber with the aid of an elastic band stretched transversely around both cover and projectile chamber said band seated in corresponding slots formed in the edges of the opposing sides of the detachable projectile chamber cover.

Other objects of the invention are to provide a multi-shot arrow bearing the aforementioned objects in mind which is of simple construction, has a minimum number of parts, is inexpensive to manufacture and efficient in operation.

BEST MODE FOR CARRYING OUT THE INVENTION

Figure 1:
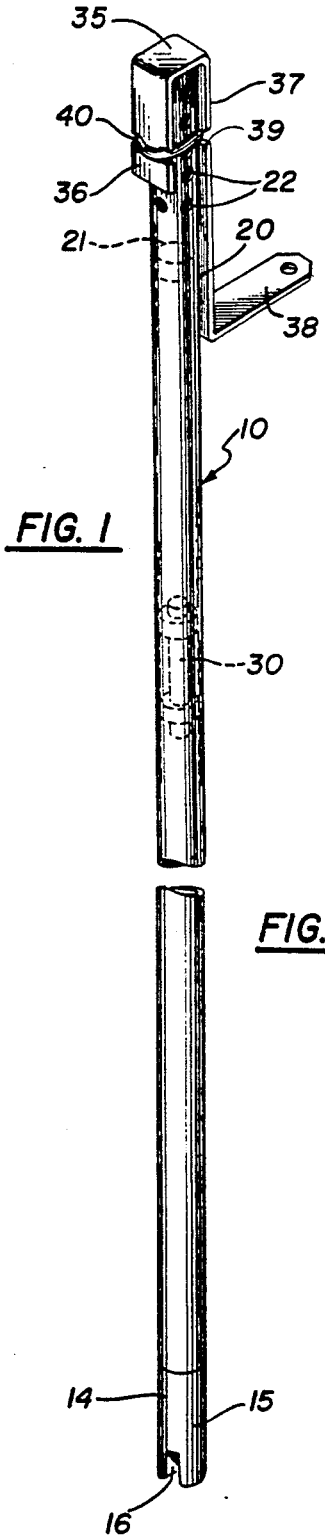
FIG. 1 is a perspective view of an arrow assembly made in accordance with the present invention.
Figure 2:
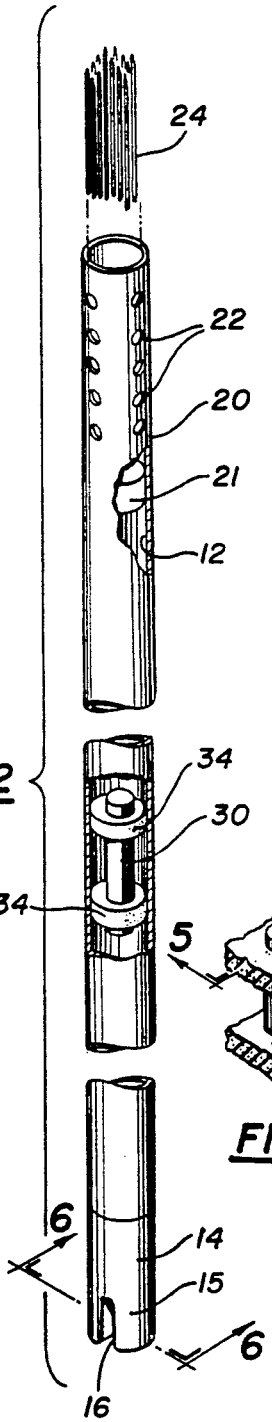
FIG. 2 is an enlarged perspective view, with parts broken away of the arrow shown in FIG. 1, sans FIG. 7, illustrating the manner in which the device is used.

With reference now in more detail to FIG. 1; one embodiment of the multi-shot arrow 10 made in accordance with the present invention is shown to include an elongated tubular shaft 12 having a longitudinal bore extending through the interior thereof.

One tail end of the shaft 12 is provided with a combination resilient notch plug 14 having a diametrically extending slot 15-16 for receiving the bowstring therewithin.

A chamber 20 having a plurality of vent holes 22 has a back wall 21 that is positional transversely in the bore and secured within the bore of the opposite forward end of the shaft 12.

With reference now in more detail to FIG. 1: one embodiment of the multi-shot arrow 10 made in accordance with the present invention is: Small needle like projectiles 24 are secured within such chamber 20 for simultaneous release following the release of the arrow from the bowstring of the bow, in a manner hereinafter more fully described.

A weighted object 30 having annular grooves 32 at each end, is provided with a pair of sponge-type pads 34 mounted within the grooves 32, such pads 34 slidably and frictionally engaging the interior of the longitudinal bore of the shaft 12.

In actual use, the weight 30 can be positioned along the length of shaft 12 simply by shaking the shaft 12 in one direction to the other. Thus, when the arrow is released from the bow string, the shaft 12 will move forwardly relative to the weight 30 which will alternately strike against the resilient plug 14 within the tail end of the shaft 12, and tend to impede or brake continued forward movement of the shaft 12. At this point, all of the small needle like projectiles 24 contained within the chamber 20 will continue their forward flight by inertia toward the target.

If desired, the position of the weight 30 can be adjusted along the length of the shaft 12 thus hastening or retarding the braking action, so as to control the length of the path flight of the arrow.

It will now also be recognized that by utilizing this braking action of the shaft 12, the arrow 10 is more easily retrieved, and the multiplicity of small needle like projectiles 24 increases the chances of striking the target.

Figure 7:
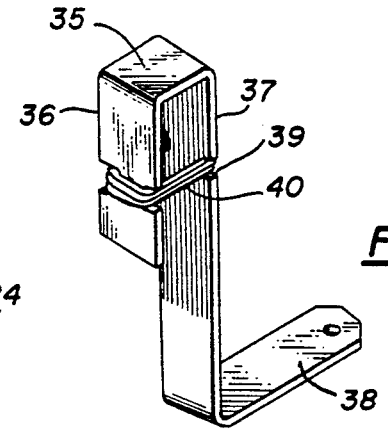
FIG. 7 is a perspective view of the projectile chamber cover device independent of the arrow proper.
Figure 3:
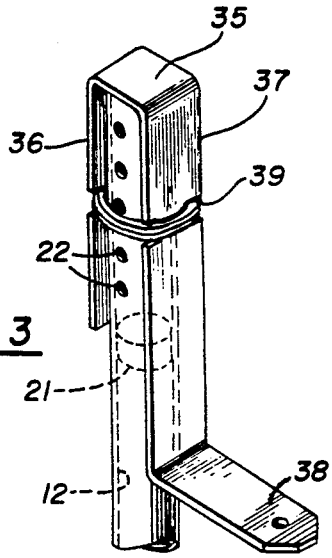
FIG. 3 is an enlarged fragmentary bottom perspective view of certain parts of the assembly shown in FIG. 1 and FIG. 2.
Figure 4:
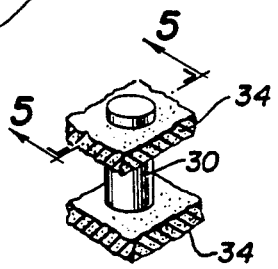
FIG. 4 is an enlarged perspective view of an inertia member forming a part of the present invention.
Figure 5:
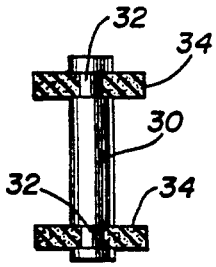
FIG. 5 is a longitudinal cross sectional view of the device shown in FIG. 4.
Figure 6:
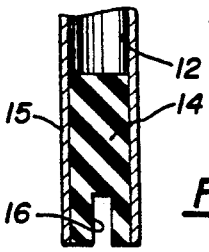
FIG. 6 is an enlarged fragmentary cross sectional view taken along line 6—6 of FIG. 2.

The projectile chamber cover, FIG. 7 comprising in combination a S shaped metallic configuration, said cover 7 having opposing sides 36 and 37 of varying length, the longer of the two sides 37 having at its aft end a flange 38, said flange 38 bent at a 90 degree angle from the longitudinal plane of said side 37. The purpose of said flange 38 being the means 38 for aiding in the detachment of the cover 7 from the projectile chamber 20 by said flange 38 making contact with the bow while the arrow 10 is being drawn to near its full length, thus detaching said cover 7 from the arrow 10 just prior to the release of said arrow 10 from the pulled bowstring.

The closed end 35 of the S shaped cover 7 has a flat area 35 that caps the exit end of the projectile chamber 20. Corresponding slots 39 formed in the edges of the opposing sides 36 and 37 near the closed end 35 of the S shaped cover 7 hold captive a transversely positioned elastic band 40 encompassing both projectile chamber 20 and U shaped cover 7, while the projectile chamber 20 is longitudinally aligned between the sides 36 and 37.

While various changes may be made in the detailed construction it shall be understood that such changes shall be within the spirit and scope of the present invention as defined by the appended claims.

What I claim as new and desire to protect by Letters Patent of the United States is:

1. A multi-shot arrow comprising in combination:

a hollow shaft having a forward part and a rearward part defined by an elongate tubular wall having a diameter, a front end and a rear end;

a resilient plug having opposite ends mounted at one end to the rearward part of said shaft and having a rearwardly extending bow string receiving notch formed in the other end thereof;

a projectile chamber in the forward part of shaft defined by the tubular wall of the shaft and a wall blocking said tube at a location spaced rearwardly from the front end, said chamber having a normally open forward end at the front end of tubular wall;

a detachable containment cover for closing said normally open forward end of said chamber, said cover comprising a first leg having opposite ends, said first leg having a length and width at least as greta as said wall diameter, a second leg secured to said first leg at one of its ends perpendicular thereto and having a length, a third leg secured to first leg at its other end perpendicular thereto, opposite and parallel to said second leg and having a length greater than second leg, and a fourth leg secured to said third leg perpendicular thereto at a location further from first leg than the length of said second leg, whereby said cover may be positioned on said shaft with said first leg abutting said front end and covering said chamber forward end, said tubular wall being positioned between said second and third leg;

means for removably retaining said cover on said shaft when positioned thereon and;

means for braking forward motion of said shaft when propelled from a bow comprising a weight slidably positioned in said shaft between said blocking wall and said resilient plug.

2. The combination according to claim 1 and further comprising a plurality of venting holes in the tubular wall between said front end and said blocking wall.

3. The combination according to claim 1 wherein said weight is elongate with opposite ends and further comprising a pair of circumferential friction pads secured at the opposite ends of said weight and frictionally engaging the inside of said tubular wall.

4. The combination according to claim 1 and further comprising slots formed in opposite edges of said second and third walls and wherein said means for removably retaining said cover comprises an elastic band seatable in said slots and surrounding said second and third legs and said tubular wall when said cover is positioned on said shaft.

* * * * *